US007811017B2

(12) United States Patent
Spencer et al.

(10) Patent No.: US 7,811,017 B2
(45) Date of Patent: Oct. 12, 2010

(54) MEDIA PATH CROSSOVER FOR PRINTING SYSTEM

(75) Inventors: Stan Alan Spencer, Rochester, NY (US); Daniel W. Costanza, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 569 days.

(21) Appl. No.: 11/248,044

(22) Filed: Oct. 12, 2005

(65) Prior Publication Data

US 2007/0081064 A1 Apr. 12, 2007

(51) Int. Cl.
*B41J 11/58* (2006.01)

(52) U.S. Cl. ..... 400/624; 399/401; 399/402; 271/3.19; 271/225; 271/287; 271/288; 271/289; 271/296

(58) Field of Classification Search ..... 400/528, 400/599, 605, 608.4, 611, 624; 347/104, 347/264; 399/382, 361, 364, 388, 397, 401, 399/402, 299; 277/3.19; 271/302, 184, 185, 271/225, 3.19, 9.13, 303, 304, 605, 289, 271/290, 287, 288; 355/23, 24; *B41J 11/42; B65H 29/00, B65H 29/60, 29/64, 9/16; G03G 21/00*
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,303,017 A * 4/1994 Smith ..... 399/403
5,326,093 A 7/1994 Sollitt
5,435,544 A 7/1995 Mandel
5,457,524 A 10/1995 Metcalf et al.
5,473,419 A 12/1995 Russel et al.
5,489,969 A 2/1996 Soler et al.
5,504,568 A 4/1996 Saraswat et al.

(Continued)

FOREIGN PATENT DOCUMENTS

JP 61127560 A * 6/1986

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Ren Yan
*Assistant Examiner*—Matthew G Marini
(74) *Attorney, Agent, or Firm*—Fay Sharpe LLP

(57) ABSTRACT

A non-gated print media crossover for a printing system includes crossover pathways which intersect at a crossover junction. A control system controls arrival of sheets of print media at the crossover junction whereby a sheet conveyed on the first crossover pathway traverses the junction in an inter-sheet gap between sheets traversing the junction on the second crossover pathway. The printing system includes print media processing units, such as marking engines, paper sources, and output destinations, which are connected by a conveyor system incorporating the crossover.

9 Claims, 4 Drawing Sheets

U.S. PATENT DOCUMENTS

| | | | | |
|---|---|---|---|---|
| 5,525,031 | A | 6/1996 | Fox | |
| 5,557,367 | A | 9/1996 | Yang et al. | |
| 5,568,246 | A | 10/1996 | Keller et al. | |
| 5,570,172 | A | 10/1996 | Acquaviva | |
| 5,596,416 | A | 1/1997 | Barry et al. | |
| 5,617,214 | A | 4/1997 | Webster et al. | |
| 5,629,762 | A | 5/1997 | Mahoney et al. | |
| 5,710,968 | A | 1/1998 | Clark et al. | |
| 5,720,478 | A | 2/1998 | Carter et al. | |
| 5,778,377 | A | 7/1998 | Marlin et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,101,364 | A * | 8/2000 | Boehmer et al. | 399/361 |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,606,165 | B1 | 8/2003 | Barry et al. | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,888,644 | B2 | 5/2005 | Barry et al. | |
| 6,925,283 | B1 | 8/2005 | Mandel et al. | |
| 7,079,805 | B2 * | 7/2006 | Suzuki | 399/401 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 * | 8/2004 | Biegelsen et al. | 271/303 |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman, et al.

* cited by examiner

MEDIA PATH CROSSOVER FOR PRINTING SYSTEM

BACKGROUND

The exemplary embodiment relates to the printing arts. It finds particular application in connection with the transport of print media through a paper path intersection within a printing system, and will be described with particular reference thereto. However, it will be appreciated that the exemplary embodiment finds application in other systems.

Electronic image forming systems, such as printing systems, typically employ an input terminal which receives images in digital form and conversion electronics for converting the image to image signals or pixels. For example, the printing system may include a scanner for scanning image-bearing documents or be connected to a computer network which supplies the digital images. The image signals are stored and are read out successively to a marking engine for formation of the images and transfer of the images to a print medium, such as sheets of paper.

In typical xerographic (electrophotographic) printing systems, such as copy machines and laser beam printers, the marking engine includes a photoconductive insulating member, which is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the paper. The fusing of the toner image onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the paper to create a multi-layered toner image on the paper. The multi-layered toner image is then permanently affixed to the paper in the fusing process.

Printing systems have been developed which employ multiple marking engines for providing higher print outputs by distributing a print job among the marking engines. These systems may include several black, process (or full) color, and/or custom color (single color or monochrome) marking engines for printing of selected pages within a print job. A conveyor system transports the sheets of print media within the printing system. Decision gates are used to control the flow of sheets through the points where one pathway merges with another, to prevent collisions between merging sheets. The gate is controlled to open when there is a sufficient inter-document gap for an incoming sheet to merge with the sheets already on a pathway.

The timing of the decision gate, its actuation, and return for a subsequent sheet are often critical for efficient operation of the printing system. However, the decision gate includes mechanical components, such as solenoids, linkages, springs, and a gate which can wear and fail to function over time resulting in lower reliability of the system. In addition, the gate tends to create a catch point area where the sheets may jam. Further, the gate takes a finite amount of time to operate, which may limit the maximum productivity of the printing system, particularly when the gate is in frequent use. Another problem arises from merging the output of multiple marking engines. The relatively lower speed output of each marking engine is generally merged into an accelerated, high velocity main media pathway.

CROSS REFERENCE TO RELATED PATENTS AND APPLICATIONS

The following applications, the disclosures of each being totally incorporated herein by reference are mentioned:

application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES;"

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,566, filed Apr. 19, 2005, entitled "MEDIA TRANSPORT SYSTEM," by Barry P. Mandel, et al.;

U.S. application Ser. No. 11/166,961, filed Jun. 24, 2005, entitled "PRINTING SYSTEM SHEET FEEDER," by Steven R. Moore; and U.S. application Ser. No. 11/166,299, filed Jun. 24, 2005, entitled "PRINTING SYSTEM," by Steven R. Moore.

INCORPORATION BY REFERENCE

U.S. Pat. No. 6,925,283, entitled "HIGH PRINT RATE MERGING AND FINISHING SYSTEM FOR PRINTING," by Mandel, et al., and Published Application 2005/0158094, entitled "HIGH PRINT RATE MERGING AND FINISHING SYSTEM FOR PARALLEL PRINTING," by Mandel, et al., the disclosures of which are incorporated herein in their entireties by reference, both disclose a media path system operable to transport the printed media from marking engines to one or more finishing stations such that the streams are merged and transported one on top of the other. A gate system controls a media path element where the paths merge.

U.S. Pat. No. 5,457,524, entitled "DUAL PATH SHEET FEEDER," by Metcalf, et al., the disclosure of which is incorporated herein in its entirety by reference, discloses a dual path sheet feeder, wherein a movable gate is situated adjacent to a sheet feeding tray for directing sheets along a predetermined path of travel. The movable gate is selectively positionable between a first position for directing the sheets to a processing module to produce copy sheets and a second position for directing the sheets directly to the finishing module to bypass the processing module to provide an insert sheet.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages): U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al., U.S. application Ser. No. 10/924,459, filed Aug. 23, 2004, entitled "PARALLEL PRINTING ARCHITECTURE USING IMAGE MARKING ENGINE MODULES," by Mandel, et al., U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; 4,579,446 to Fujino; U.S. Pat. No. 5,489,969 to Soler, et al.; U.S. Pat. No. 6,606,165 and U.S. Pat. No. 6,888,644 to Barry, et al., a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

Aspects of the exemplary embodiment relate to a media path crossover, to a printing system incorporating a media path crossover, and to a method of printing.

In one aspect, a non-gated media path crossover includes a first crossover pathway on which sheets of print media are conveyed across a crossover junction without interruption and a second crossover pathway on which sheets of print media are conveyed across the crossover junction without interruption. The second crossover pathway intersects the first crossover pathway at a crossover junction. A control system controls the arrival of the sheets of print media at the crossover junction, whereby a sheet on the first crossover pathway traverses the junction in an intersheet gap between sheets traversing the junction on the second crossover pathway.

In another aspect, a printing system includes a first print media processing unit and a second print media processing unit. A passive media path crossover includes a first crossover pathway on which sheets of print media are conveyed and a second crossover pathway on which sheets of print media are conveyed. The first crossover pathway receives print media from the first print media processing unit. The second crossover pathway receives print media which has bypassed the first print media processing unit. The second crossover pathway intersects the first crossover pathway at a crossover junction. One of the first and second crossover pathways is connected with the second print media processing unit. A control system controls arrival of the sheets of print media at the crossover junction, whereby a sheet conveyed on the first crossover pathway traverses the junction in an intersheet gap between sheets traversing the junction on the second crossover pathway.

In another aspect, a printing system includes a first marking engine, a second marking engine, a source of print media, an output destination, and a print media conveyor system. The conveyor system conveys sheets of print media between the source of print media and the first and second marking engines and between the first and second marking engines and the output destination. The conveyor system includes a first main pathway and a second main pathway and a media path crossover. The media path crossover connects the first and second main pathways. The media path crossover includes a first crossover pathway and a second crossover pathway which crosses the first crossover pathway. A control system selectively routes print media from the first and second main pathways to the media path crossover. The printing system has a first mode of operation and a second mode of operation. In the first mode of operation, the control system routes a first portion of the print media to the first crossover pathway of the media path crossover and a second portion of the print media to the second crossover pathway of the media path crossover. The second portion of the print media crosses the first pathway in intersheet gaps between sheets of the first portion of the print media. In the second mode of operation, the control system routes print media along at least one of the first and second main pathways to bypass the media path crossover.

In another aspect, a method of printing includes conveying sheets of print media on a first crossover pathway of a print media crossover and conveying sheets of print media on a second crossover pathway of the print media crossover which intersects the first crossover pathway at a junction. Arrival of the sheets of print media at the junction is controlled such that print media on the second crossover pathway crosses the junction in inter sheet gaps between sheets crossing the junction on the first crossover pathway.

DETAILED DESCRIPTION

Figure 1:
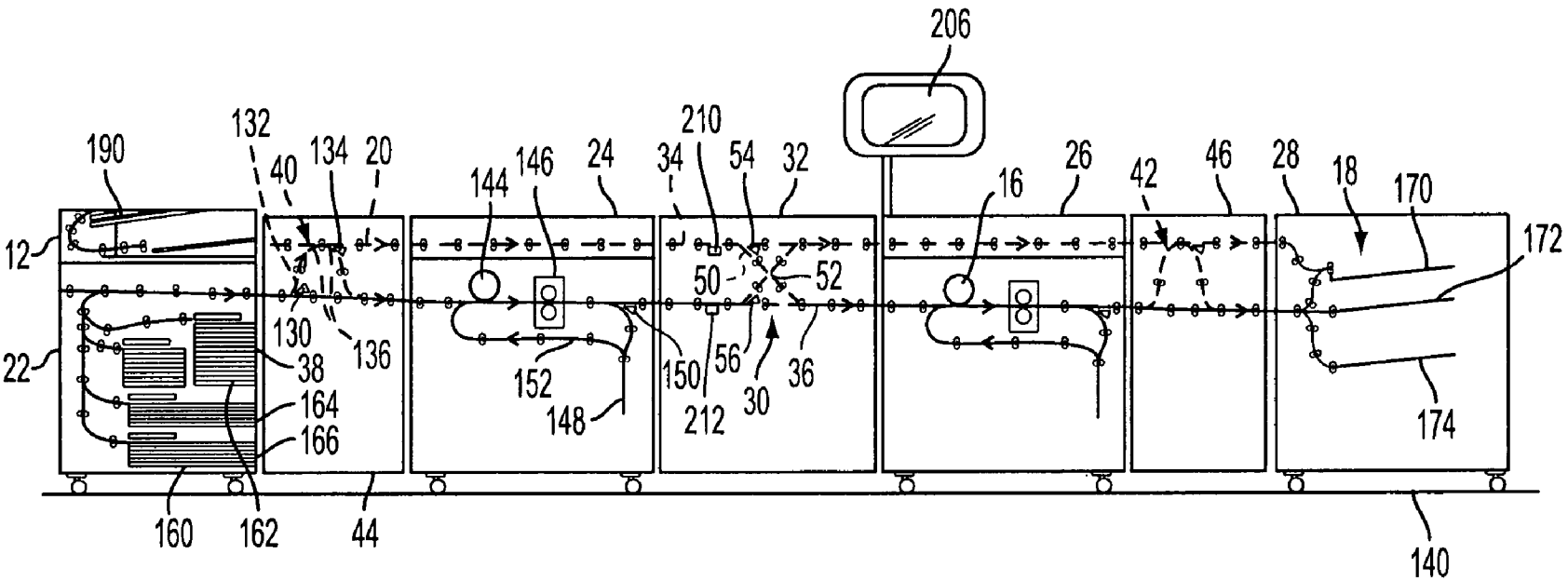
FIG. 1 is a schematic view of a printing system incorporating a media path crossover according to aspects of the exemplary embodiment.

Aspects of the exemplary embodiment relate to a media path crossover for a printing system, to a printing system which incorporates the media path crossover, and to a method of printing. The media path crossover includes first and second pathways which intersect at a crossover junction. The first pathway includes an input path which carries sheets of print media to the crossover junction and an output path which carries the print media sheets from the junction, the output path receiving print media sheets from the input path. Similarly, the second pathway includes an input path which carries print media sheets to the crossover junction and an output path which carries print media sheets from the junction, the output path receiving print media sheets from the input path. The crossover junction serves as a portion of both pathways. Sheets traveling on the first and second pathways can both pass through the junction. However, a sheet cannot traverse the junction from one of the pathways while a sheet in the other pathway is simultaneously in the junction as this would result in a collision. Accordingly, the entry of sheets to the crossover junction is staggered. Specifically, a control system controls the arrival of print media sheets at the crossover junction whereby sheets on the first pathway traverse the junction in intersheet gaps between sheets traversing the junction on the second pathway. In this way, collisions between sheets are avoided without the need for a gate system. The crossover can thus be non-gated, i.e., sheets entering the junction from one or both pathways need not be interrupted by a gate, but are timed to arrive at the junction in the intersheet gaps. The crossover and its components (such as baffles) are thus passive, in that they remain in the same position irrespective of the direction of movement of the print media through the crossover. It will be appreciated that a gate may be provided within the crossover for use in some applications but that the crossover can still be run in a not-gated mode where the gate is not closed between sheets of a print job or otherwise operated to interrupt the flow.

In various aspects, the printing system includes a plurality of marking engines and a conveyor system which conveys print media between the marking engines and a common output destination. The conveyor system includes a media path crossover whereby sheets which have been marked by a first of the marking engines can bypass a second of the marking engines and/or sheets which have bypassed the first marking engine can be marked by the second marking engine.

The media path crossover is particularly suited to printing systems comprising marking engines which can selectively operate in two modes: a first mode, such as a simplex mode and a second mode, such as a tandem duplex mode. In the first mode, a portion of the sheets can be marked by a first marking engine and bypass a second marking engine and a different portion of the sheets can be marked in the second marking engine, bypassing the first marking engine. The outputs of the two marking engines can then be merged into a single stream and the marked sheets subsequently assembled at the common output destination. This can be used for simplex printing, in which the two marking engines only print on one side of the sheets. Alternatively, in some embodiments, the first mode may be used for single engine duplex printing, where there are print media pathways provided for returning print media to the same marking engine. In single engine duplex printing, sheets printed by a marking engine are inverted and routed to the same marking engine for printing on the other side of the sheet. As with simplex printing, in single engine duplex printing, a portion of the sheets can be printed on the first marking engine and a second, different portion of the sheets can be printed on the second marking engine.

In the second mode, a sheet can be marked by the first marking engine, inverted, and conveyed to the second marking engine for printing on the other side of the same sheet (tandem duplex printing). Alternatively, in the second mode, in some embodiments, sheets can be conveyed from the first marking engine to the second marking engine without inversion, for marking on the same side of the sheet (overprinting).

When operated in the first mode, all or a large proportion of the sheets pass through the media path crossover. In the second mode, sheets can be directed directly from the first marking engine to the second marking engine, bypassing the media path crossover. Such a printing system has advantages over one which employs a gated sheet merging system in that relatively high speeds can be maintained for the sheets passing through the junction and it avoids the aforementioned problems which may arise when a gate is used. It will be appreciated, however, that the media path crossover is not limited to such uses and may be used in other applications where print media pathways intersect. For example, the media path crossover may be used to selectively direct sheets output from two or more marking engines to two or more output destinations or to selectively direct print media from two or more print media sources to two or more marking engines.

The term "marking engine" is used herein generally to refer to a device for applying an image to print media. Print media generally refers to a usually flexible, sometimes curled, physical sheet of paper, plastic, or other suitable physical print media substrate for images, whether precut or web fed. A "printing system" can be a digital copier or printer, bookmaking machine, facsimile machine, multi-function machine, or the like and can include several marking engines, as well as other print media processing units, such as paper feeders, finishers, and the like. "Print jobs" or "documents" generally include a plurality of digital "pages" to be rendered as one or more copies on a set of associated sheets of print media, each page, when rendered constituting the front or back side of a sheet. The pages of a print job may arrive from a common source and, when rendered, be assembled at a common output destination.

The printing system generally includes two or more marking engines of the same print modality, such as black only (K), process color (P), or custom color (C) marking engines, and which can be used interchangeably for at least some of the print jobs or portions thereof that are handled by the printing system. The printing system may be configured for parallel printing such that portions of a print job may be distributed among two or more marking engines of the same print modality and then assembled as a single document or such that several print jobs may be distributed among the marking engines whereby two or more print jobs may be printed contemporaneously. Additionally or alternatively, the printing system may be configured for printing opposite sides of a sheet on different marking engines (tandem duplex printing).

With reference to FIG. 1, an exemplary printing system 10 in which the media path crossover and printing methods disclosed herein may be employed is shown. The printing system 10 may be a printer, copier, or a multifunction device having both printing and copying capabilities. The illustrated printing system 10 is a modular system and includes a plurality of print media processing units, such as a print media source 12, a plurality of marking engines 14, 16, and an output destination 18, such as a finisher. The processing units 12, 14, 16, and 18 are all interconnected by a print media conveyor system 20.

In some embodiments, one or more of the print media processing units are modular and are housed in a respective housing 22, 24, 26, and 28. The modules may be interconnectable and interchangeable to allow the printing system to be reconfigured so to include for fewer or more print media processing units. In some embodiments, one or more of the processing units 12, 14, 16, 18 are removable processing units. For example, the functional portion of a processing unit may be removed, leaving only the external housing 22, 24, 26, 28 or mounting fixture through which the print media conveyor 20 passes. In this manner, for example, the functional portion can be removed for repair, or can be replaced to effectuate an upgrade or modification of the printing system 10.

The printing system 10 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper source 12, marking engines 14, 16, and finisher 18 of the printing system 10. These capabilities may increase over time due to addition of new processing units or upgrading of existing processing units. The capabilities may also decrease over time due to failure or removal of one or more processing units.

The conveyor system 20 includes a media path crossover 30, which may be in the form of a separate module which is housed in its own housing 32, as shown, or may be incorporated into one or more of the other processing modules. In the illustrated embodiment, the media path crossover 30 connects parallel downstream main pathways 34, 36 of the conveyor system 20. Pathway 34 is a bypass pathway which conveys sheets 38 of print media between the print media source 12 and the output destination. The pathway 34 bypasses both marking engines 14, 16. Pathway 36 conveys sheets of print media from the first marking engine 14 to the second marking engine 16, e.g., for tandem duplex printing (where marking engines 14 and 16 print on opposite sides of the same sheet) or for overprinting (both marking engines 14 and 16 print on the same side of the sheet). Pathway 36 may also interconnect the first marking engine 14 with the paper source 12 and the second marking engine 16 with the output destination 18.

Sheets 38 of print media are conveyed between the pathways 34, 36 for selective direction of the sheets to one or other of the marking engines 14, 16. In the illustrated embodiment, sheets are transferred between the main pathways 34, 36 via the media path crossover 30, at a location which is intermediate the first and second marking engines 14, 16. Sheets can also be transferred between the pathways 34, 36 in first and second bell modules 40, 42 located upstream of the first marking engine 14 and downstream of the second marking engine 16, respectively. The bell modules 40, 42 may be housed in respective housings 44, 46, and be replaceable and/or interchangeable conveyor modules of the printing system 10, as for the crossover module 30. In the illustrated embodiment, the bell modules 40, 42 space the marking engines 14, 16 from the print media source 12 and output destination 18, respectively. It is to be appreciated that the printing system may include additional conveyor modules to those illustrated.

Figure 2:
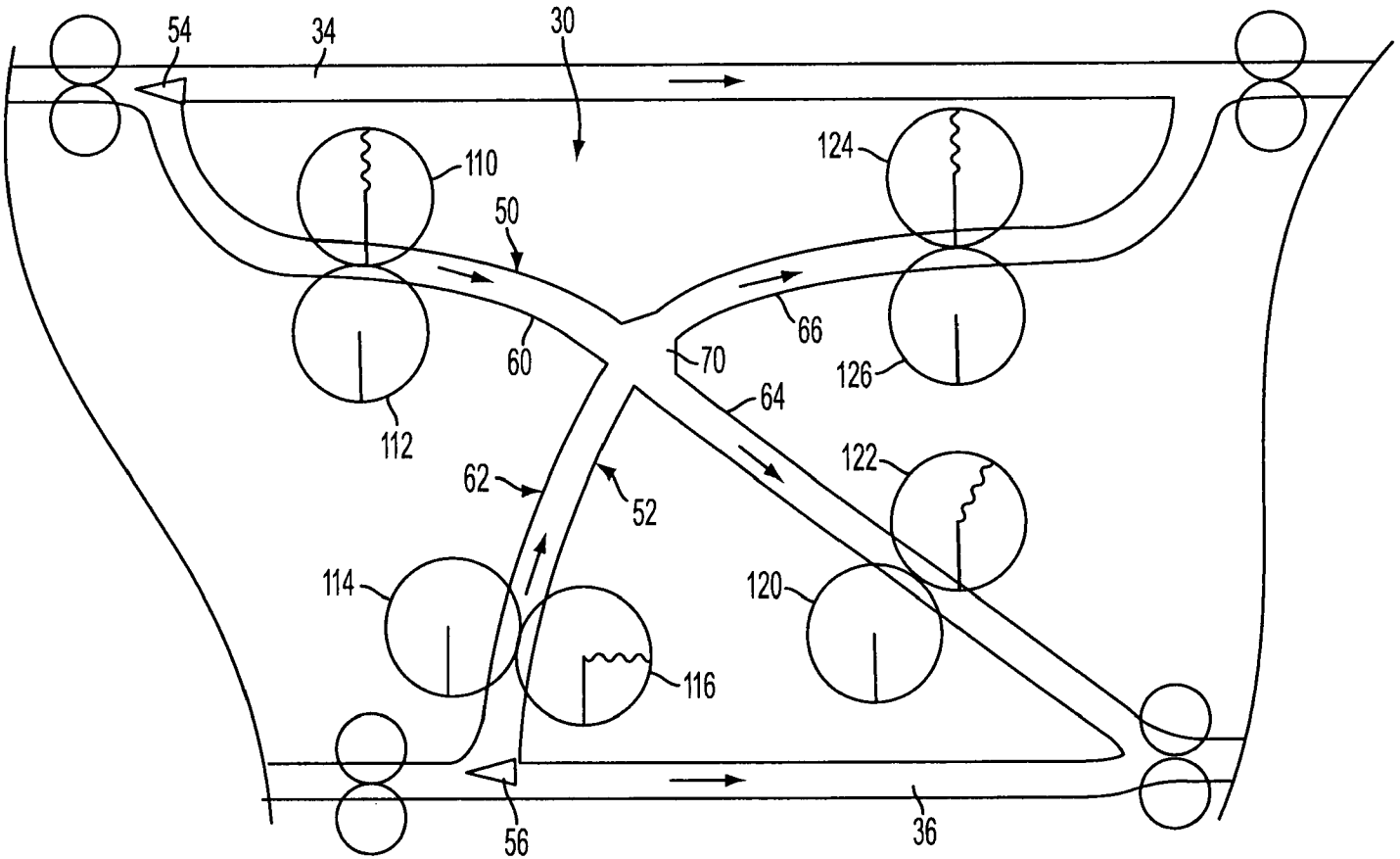
FIG. 2 is an enlarged cross sectional view of the media path crossover of FIG. 1.

With reference also to FIG. 2, the media path crossover 30 includes two intersecting pathways: a first crossover pathway 50 and a second crossover pathway 52, which crosses pathway 50. Ends of the pathways 50, 52 connect main pathways 34 and 36. In the embodiment of FIG. 1, pathway 50 conveys sheets of print media between pathways 34 and 36 such that print media which has bypassed marking engine 14 can be directed to marking engine 16 for marking. Similarly, pathway 52 conveys print media between pathways 36 and 34 such that print media which has been marked by marking engine 14 can bypass marking engine 16. In this way, the printing system 10 can be used for simplex printing or single engine duplex printing, in which the outputs of the two marking engines 14,.16 are combined to enable an increase in productivity of the system 10 over that of a single marking engine. When operated in a simplex printing mode, for example, a portion (typically half) of the sheets of a print job to be printed are transported via pathway 36 to marking engine 14 and are thereafter transferred from pathway 36 to pathway 34 at the media path crossover 30, thereby bypassing the second marking engine 16. A second portion (typically the remainder of the print job) is directed to marking engine 16. Sheets to be marked bypass marking engine 14 and then crossover from pathway 34 to pathway 36 via crossover 30. The two portions are subsequently combined in output order, for example, by merging the output of marking engine 14 into pathway 36 in the bell module 42, downstream of marking engine 16.

It is to be appreciated, that the media path crossover 30 may include more than two intersecting pathways. It is also contemplated that the printing system 10 may include more than one media path crossover 30. For example, a printing system which incorporates more than two marking engines may have additional media path crossovers. Additionally or alternatively, media path crossovers may be provided upstream of both marking engines 14, 16 and/or downstream of both marking engines, such as in the locations of the bell modules 40, 42.

With continued reference to FIGS. 1 and 2, the print media sheets may be directed from respective pathways 34, 36 into pathways 50, 52 by selectable decision gates 54, 56. The decision gates 54, 56 each have a first position, in which the print media continues on the main pathway 34, 36, respectively, and a second position, in which the print media is directed into the media path crossover 30. Decision gates of this type are disclosed, for example, in U.S. Pat. No. 5,457,524, incorporated herein in its entirety, by reference.

Figure 3:
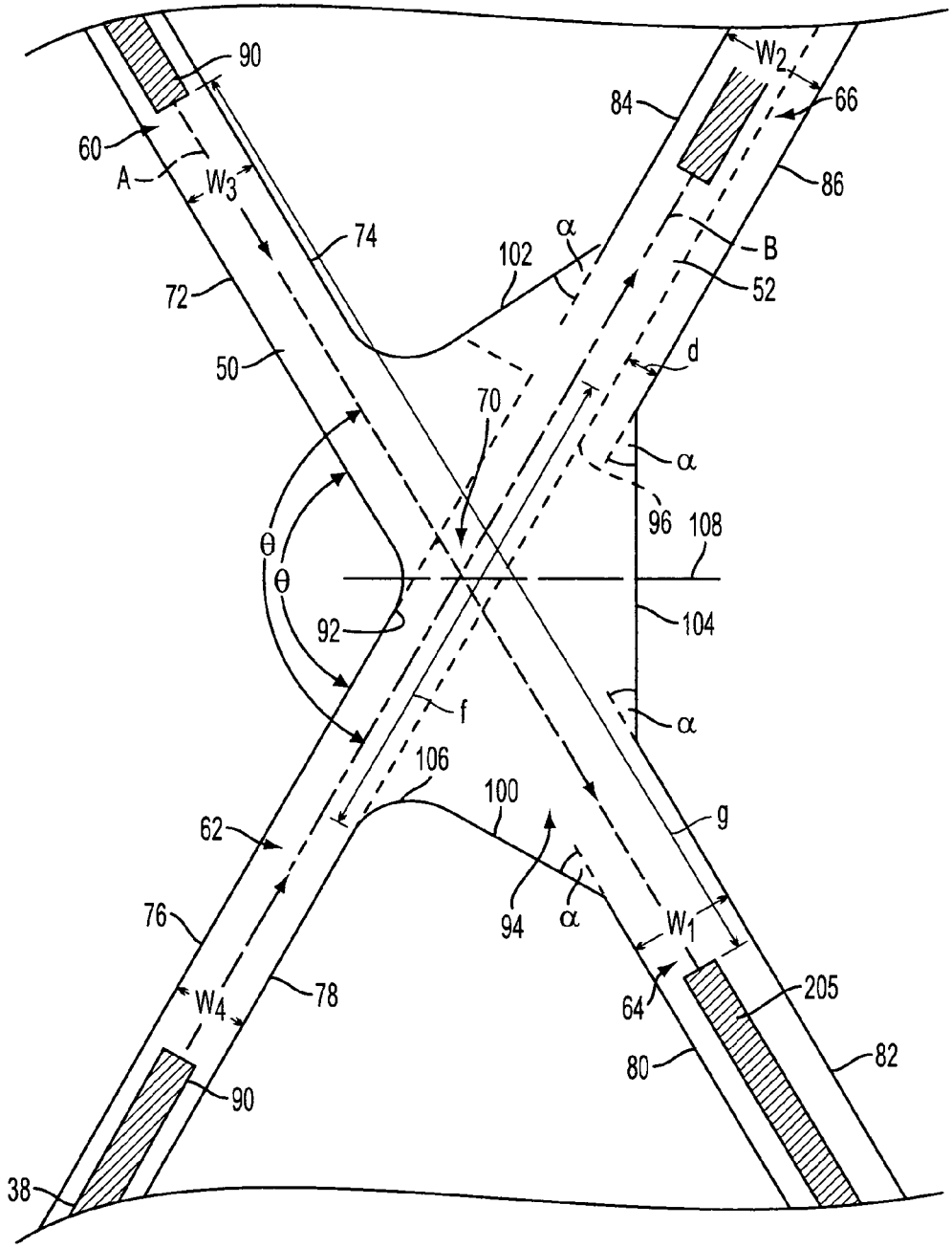
FIG. 3 is a greatly enlarged sectional view of the media path crossover of FIG. 1.

With reference to FIG. 2 and reference also to FIG. 3, the pathways 50 52 of the illustrated media path crossover 30 each include an inlet path 60, 62 and an outlet path 64, 66, respectively. The pathways 50, 52 cross at a four way junction 70, which connects inlet path 60 with outlet path 64 and inlet path 62, with outlet path 64. The illustrated junction 70 is configured such that sheets entering from inlet path 60 are steered toward outlet path 64 and sheets entering from inlet path 62 are steered toward outlet path 66. In general, sheets from path 60 are directed away from outlet path 66 and away from inlet path 62, such that the sheets continue along pathway 50. Similarly, sheets from path 62 are directed away from outlet path 64 and away from inlet path 60, such that the sheets continue along pathway 52.

In the simplex mode, the decision gates 54, 56 can be set in the position to direct all the print media to the crossover 30 for an entire print job or jobs to be simplex printed. In this way, successive sheets traverse the junction from either direction without interruption by a gate. Similarly, in the tandem duplex mode, the gate 56 is set such that all the print media of a print job is directed along main pathway 36, without interruption by a gate.

With reference to FIG. 3, the inlet paths 60, 62 of paths 50, 52 are defined by a static baffle structure comprising baffles 72, 74, 76, 78, respectively, which constrain the sheets 38 to travel along a general route indicated by arrows A and B, respectively, and enter the junction 70 at an angle θ. The angle θ, as defined by the angle between baffles 72 and 76, may be, for example, from about 80° to about 140° and in one embodiment, is at least 100°. In one specific embodiment, θ is at least about 110°, e.g., about 120°. Similarly, the outlet paths 64, 66 are defined by respective baffles 80, 82, 84, 86. The positions of the baffles are fixed. They do not move as in a gated structure.

It will be appreciated that once a leading edge 90 of a sheet enters the junction 70, it is no longer supported by the baffles 72, 74, 76, 78. As a result, the leading edge 90 of a sheet 38 entering from inlet path 62 in an upward direction may have a tendency to bend, depending on the flexibility of the sheet, towards the outlet path 64 of the other pathway 50. Similarly, the leading edge 90 of a sheet entering the junction 70 from path 60 may have a tendency to flex towards inlet path 62. To diminish this tendency, in various aspects of the exemplary embodiment, the lower baffle 86 of the outlet path 66 is generally parallel with lower baffle 78 and offset outward therefrom by a distance d such that parallel portions of baffles 84 and 84 are wider apart than corresponding parallel portions of baffles 76, 78. Similarly, baffles 80, 82 are wider apart than baffles 72, 74. Additionally, the distance f between the take off point of baffle 78 and baffle 86 is less than a length of the sheet passing through the crossover, e.g., less than ⅔ the length of the sheet and in some embodiments, about half the length of the sheet. The exact length f which can be maintained will depend, to some extent, on the flexibility of the sheet and its tendency to curl during the marking process. The baffles 72, 76 intersect at a region 92 which may be slightly radiused. Region 92 is closer to the junction than any of the other baffles. Additionally, baffles 80, 82, 84, and 86 extend outwardly adjacent the junction 70 to define throat regions 94, 96 which are wider than the respective adjacent outlet paths 64, 66, e.g., at least 1.5 times the width $w_1$, $w_2$ of the respective outlet path 64, 66 and in one embodiment, at least about twice the width. In the throat regions 94, 96, generally linear portions of the baffles 80, 84, 86, define walls 100, 102, 104, which are angled to the direction of travel of the sheets by an angle α of less than 90°. In one embodiment, α is from about 30 to about 60°, e.g., about 45°. It is to be appreciated than not all the angles α need be the same. Further, outlet paths 64, 66 may be wider than the respective inlet paths 60, 62 ($w_2>w_4$ and $w_1>w_3$). The walls 100, 102, 104 assist in guiding the sheets into the outlet paths 64, 66 and minimize the tendency for the sheet to enter another inlet path 60, 62 or cause a jam in the junction. In the illustrated embodiment, the radiused region 92 is located on the opposite side of the junction 70 from the wall 104 and intermediate ends of the wall 104, e.g., substantially midway between ends of the wall 104. An interconnection region 106 between wall 100 and baffle 78 may be similarly radiused. Wall 104 is generally vertical and may be substantially perpendicular (e.g., within about 5° of perpendicular) to an imaginary line 108 passing through the intersection of baffles 72, 76.

The print media conveyor system 20 includes drive elements associated with each of the paper pathways 34, 36, 50, 52, etc., such as rollers, spherical balls, or air jets, which convey the print media along the pathways. The pathways may include diverters, inverters, interposers, and the like, as known in the art. As illustrated in FIG. 2, the media path crossover drive elements include pairs of inlet rollers 110, 112, 114, and 116 associated with inlet paths 60, 62. At least one roller 112, 114 of each inlet pair is driven so as to rotate, in order to drive the print media sheets in the direction of the junction 70. The drive elements of crossover 30 also include pairs of outlet rollers 120, 122, 124, and 126 associated with outlet paths 64, 66. At least one roller 126, 120 of each outlet pair is driven so as to rotate, to drive the print media sheets in a direction away from the junction.

With reference once more to FIG. 1, bell module 40 will be described with the understanding that bell module 42 may be similarly configured. Sheets traveling downstream on pathway 36 can be selectively directed by a decision gate 130 associated with pathway 36 into a first connection path 132 which connects pathway 36 with pathway 34. Sheets in path 132 merge into path 34 and continue downstream, bypassing marking engine 14. Similarly, sheets traveling downstream on pathway 34 can be selectively directed by a decision gate 134 associated with pathway 34 into a second connection path 136 which connects pathway 34 with pathway 36. Sheets in path 136 merge into path 36 and enter the marking engine 14. Unlike the crossover, the paths 132, 134 of the bell module 40 do not cross. Although not shown, pathway 34 may be connected with another print media processing unit, upstream of module 40, such as a print media source or another marking engine, or with an additional portion of the conveyor system. Similarly, pathway 34 may be connected with another print media processing unit downstream of module 42, such as another marking engine, or another output destination, or with a portion of the conveyor system. Although in the illustrated embodiment, the ends of pathway 34 are essentially dead ends, they provide an easily reconfigurable printing system whereby modules can be linked in different arrangements or additional modules added, as disclosed for example, in U.S. Published Application Serial No. 20040150158, published Aug. 5, 2004, entitled "MEDIA PATH MODULES," by Biegelsen, et al.

In the illustrated printing system 10, print media which has been printed by the downstream marking engine 16 cannot be routed to an upstream marking engine 14. However, in some embodiments, return upstream pathways may be provided which enable print media to be directed from a downstream to an upstream marking engine, as disclosed, for example, in copending U.S. application Ser. No. 11/137,251, filed May 25, 2005, entitled "SCHEDULING SYSTEM," by Robert M. Lofthus et al. Additionally, while the illustrated marking engines 14, 16 are shown in a horizontal arrangement, vertical arrangements, in which two or more marking engines are stacked in a tower, are also contemplated, as disclosed for example, in copending U.S. application Ser. No. 11/137,251 and in application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al., which is incorporated herein by reference in its entirety. While the illustrated marking engines are aligned in a linear arrangement, it is also contemplated that they may be stacked in a two or three dimensional configuration.

While pathway 34 is illustrated as an upper pathway and pathway 36 as a lower pathway which runs parallel to the upper pathway and generally horizontally, i.e., generally parallel with a support surface 140, such as the ground, on which the printing system is supported, it is to be appreciated that the positions of the pathways 34, 36 may be reversed, with pathway 36 being the upper pathway. In other embodiments, pathways 34, 36 may be arranged in other orientations, such as a horizontal, side by side by side arrangement, or in a generally vertical orientation. Additionally, while pathway 34 is shown as a bypass pathway which bypasses both marking engines 14, 16, it is to be appreciated that the pathway 34 may alternatively be connected with the second marking engine and that the second pathway 36 may bypass the marking engine 16. In such an embodiment, the printing system.10 utilizes the crossover 30 when operating in the second mode, such as a tandem duplex mode, rather than in the first mode, such as a simplex mode.

It will be understood that while two marking engines 14, 16 are illustrated, the number of marking engines can be any number, such as two, three, four, five, six, or more. The two illustrated marking engines 14, 16 may both be multi-color (process color, P) marking engines, such as CMYK marking engines. However, one or more of the marking engines 14, 16 may be a monochrome engine, such as a black (K) marking engine or a custom color (C) marking engine.

The illustrated marking engines 14, 16 employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like. In a xerographic system, an image applying component 144, illustrated schematically by a photoreceptor, applies an image to the print media, and a fuser 146, such as a pair of rollers, one of which being heated, fixes the applied image to the print media by application of at least one of heat and pressure. Marking engines 16 and 18 may be similarly configured. The marking engine typically includes a charge retentive surface, such as a rotating photoreceptor in the form of a belt or drum. The images are created on a surface of the photoreceptor. Disposed at various points around the circumference of the photoreceptor are the xerographic subsystems, for forming an image and transferring the image to a sheet of paper which include a charging station for one or more of the colors to be applied, such as a charging corotron, an exposure station, which forms a latent image on the photoreceptor, such as a Raster Output Scanner (ROS) or LED bar, a developer unit, associated with each charging station for developing the latent image formed on the surface of the photoreceptor by applying a toner to obtain a toner image, a transfer unit, such as a transfer corotron, transfers the toner image thus formed to the surface of a print media substrate, such as a sheet of paper, or to an intermediate transfer belt. In one embodiment, each of four toners cyan, magenta, yellow, and black (CMYK) is applied to the same photoreceptor. In another embodiment, each may be applied to a separate photoreceptor, and the resulting image transferred to an intermediate transfer belt. The sheet with the applied image is conveyed to the fuser 146 for fixing. In any particular embodiment of an electrophotographic marking engine, there may be variations on this general outline, such as additional corotrons, cleaning devices, and the like.

An inverter 148 is connected with pathway 36, intermediate fuser 146 and marking engine 16. A decision gate 150 selectively directs marked media to the inverter 148 for inversion of the sheet. The inverter 148 may be bypassed when the printing system 10 operates in the first mode, such as a simplex mode. The illustrated marking engines 14, 16, both include a return pathway 152, by which print media which has been marked with image applying component 144 and fused with the fuser 146 is returned to the marking engine after inversion in the inverter 148, e.g., for single engine duplex printing.

While in the illustrated embodiment, main pathway 36 conveys the marking media to the image applying component 144 and fuser 146, it is to be appreciated that the marking engines 14 and 16 may be served by branch pathways, which link the marking engines 14, 16, with the main pathway(s), as disclosed, for example, in application Ser. No. 11/095,872, filed Mar. 31, 2005, entitled "PRINTING SYSTEM," by Paul C. Julien, the disclosure if which is incorporated herein by reference.

The illustrated print media source 12 is a high capacity feeder which includes print media sources 160, 162, 164, 166, such as trays, which are connected with the print media conveyor system 20 to provide selected types of print media to all of the marking engines. While four print media sources are illustrated, the number of print media sources can be one, two, three, four, five, or more. In other embodiments, one or more of the marking engines in the printing system 10 may include its own dedicated print media source. Each of the print media sources 160, 162, 164, 166 can store sheets of the same type of print medium, or can store different types of print media. The print media can be substantially any type of medium upon which one or more of the marking engines 14, 16 can print, such as: high quality bond paper, lower quality "copy" paper, overhead transparency sheets, high gloss paper, heavy weight paper and card, paper of different sizes, and the like.

The print media conveyor system 20 is controllable to acquire sheets of a selected print medium from the print media sources 160, 162, 164, 166, transfer each acquired sheet to one or more of the installed marking engines 14, 16, to perform selected marking tasks, and then transfer each sheet to the finisher 18 to perform finishing tasks. The finisher 18 receives the pages of a print job in output order and includes one or more print media output destinations, 170, 172, 174, herein illustrated by trays. While three output destinations 170, 172, 174 are illustrated, the printing system 10 may include one, two, three, four, or more print media output destinations.

In the illustrated embodiment, at least one paper source 160, 162, 164, 166 is connected by the conveyor system 20 with at least two marking engines of the same print modality, such as process color marking engines 14, 16. A print job or a plurality of print jobs employing the paper can be selectively distributed among two or more of the marking engines 14, 16 for parallel printing (two or more marking engines each performing part of a print job) or to two or more marking engines in series for tandem duplex printing or for overprinting.

Figure 4:
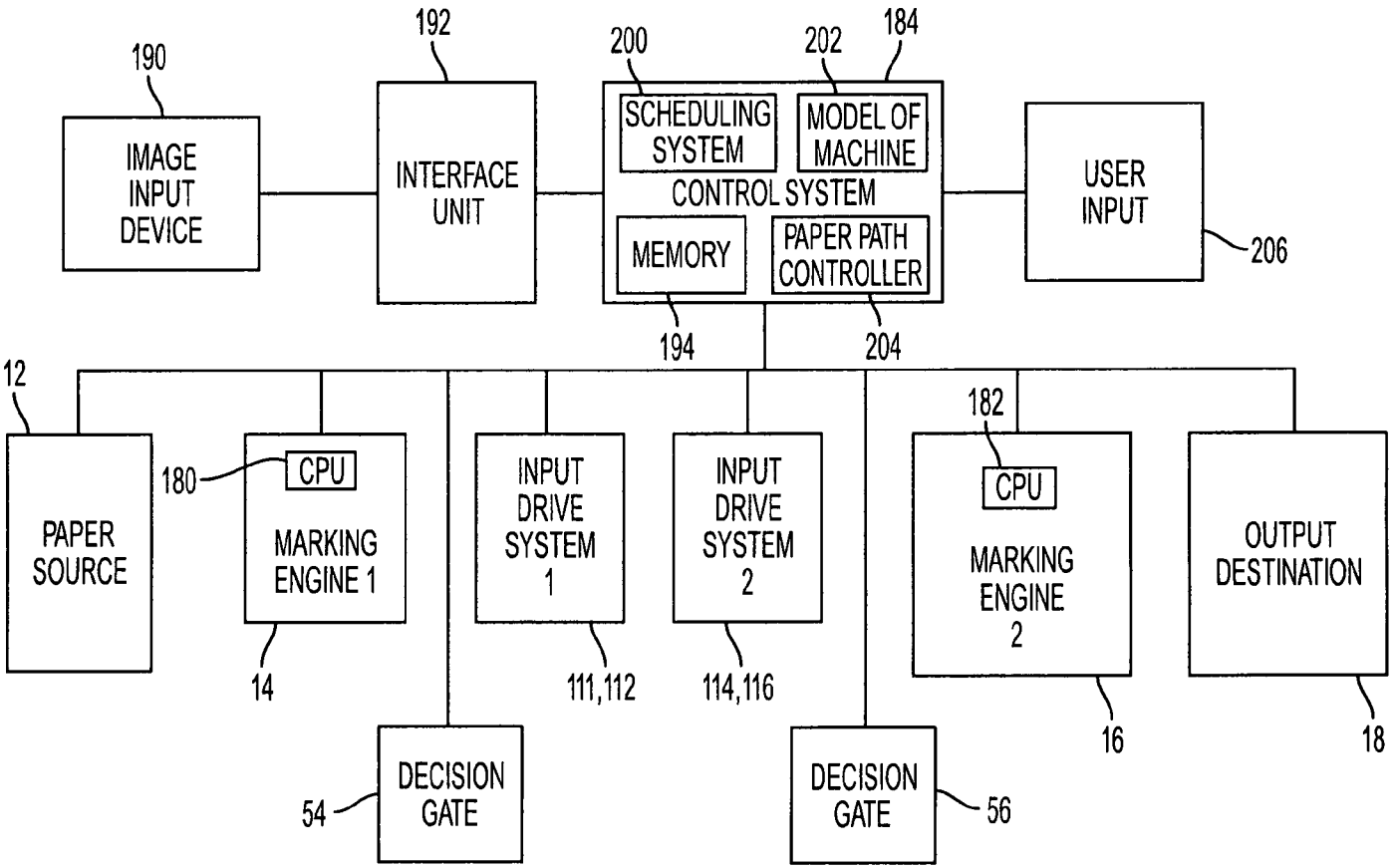
FIG. 4 is a block diagram of the printing system illustrating an exemplary control system.

With reference now to FIG. 4, the printing system includes a processing component. In the illustrated embodiment, the processing component is distributed over the printing system and includes a marking engine controller 180, 182 such as a CPU, associated with each marking engine 14, 16, which includes actuators for controlling each of the subsystems, and an overall control system 184, which communicates with the individual marking engine CPUs 180, 182. The marking engine controller 180, 182 is linked to the system controller 184 and may be also linked to other known components, such as a memory, a marking cartridge platform, a marking driver, a function switch, a self-diagnostic unit, all of which can be interconnected by a data/control bus. Each marking engine 14, 16 may have its own marking engine controller 180, 182, as shown in FIG. 4.

An image input device 190 supplies the printing system 10 with images to be printed. The image input device can comprise a built-in optical scanner, which can be used to scan a document such as book pages, a stack of printed pages, or the like, to create a digital image of the scanned document that is reproduced by printing operations performed by the printing system 10. Alternatively, or additionally, a print job can be electronically delivered to the printing system 10 via a wired or wireless connection to a digital network that interconnects, for example, personal computers (not shown) or other digital devices. The printing system optionally includes an interface unit 192, in communication with the control system 184, which converts the digital images and associated instructions into a form which can be utilized by the printing system 10. The interface unit 192 may identify the image to be associated with each sheet of the print job to be printed using information stored in a file header associated with the print job. The image content for each page may be stored as a bitmap in memory 194, to be delivered to the appropriate marking engine to which the page is later assigned for printing.

The control system 184 includes a scheduling system 200 which schedules the order of printing of incoming print jobs and identifies a marking engine or marking engines 14, 16 for printing each of the pages of the print jobs. The scheduling system 200 accesses a model of the machine 202 to obtain information on the printing system for scheduling jobs. The model of the machine 202 stores information on the capabilities of each of the marking engines of other components of the printing system. The model of the machine 202 is periodically updated with information on the current states of the marking engines 14, 16 by querying the respective marking engine CPUs 180, 182. For example, the scheduling system may receive a print job of ten pages to be copied single sided, 50 times. The scheduling system 200 may determine, by querying model of machine 202, that both marking engines are available for printing and assign pages 1, 3, 5, 7 and 9 to marking engine 16 and pages 2, 4, 6, 8, and 10 to marking engine 14. During simplex printing, the printing system is controlled such that sheets for pages 1, 3, 5, 7 and 9 are diverted from pathway 36 to pathway 34 via bell module 40, bypass marking engine 4, crossover to path 36 at crossover 30 and enter marking engine 16. Sheets for pages 2, 4, 6, 8, and 10 remain on pathway 36, are marked by marking engine 14, cross to pathway 34 via bell module 40, bypass marking engine 16, and arrive at finisher 18 in page number order with pages 1, 3, 5, 7, and 9. At the crossover, sheet 2 may cross between sheets for pages 1 and 3, the sheet for page 4 between pages 3 and 5, and so forth.

The control system 184 communicates with the marking engines 14, 16 and other components 12, 18, 20 of the printing system 10 to coordinate the printing of the print job, including the transportation of the print media to the marking engines and the collation and assembly of print jobs output by the finisher 18 according to a scheduled itinerary. In particular, the control system includes a processing component, such as a paper path controller 204, which controls the positions of decision gates 54, 56 according to whether the printing system is to operate in simplex mode or tandem duplex mode. Additionally, when print media is entering the crossover junction 70 from two directions, the control system 184 ensures that the entry of the sheets is staggered to avoid collisions. In particular, the control system 184 schedules a sheet 38 traveling in path 62 to completely pass through junction 70 in an intersheet gap g between the training edge 205 of a first sheet traveling in path 60 and a leading edge 90 of a successive sheet traveling in path 60. The control system 184 may operate on an open loop system in which the location of any sheet at any given time is predicted, based on the known operating speeds of the printing system components, such as marking engines, drive systems, and the like. However, even relatively small variations in the weight of sheets, toner developed mass, and operating speeds of the printing system components may make it difficult to determine the arrival time at the crossover accurately. Thus, for high speed printing systems where sheets are arriving at the crossover at very short time intervals, an open loop system may not be adequate. In another embodiment, therefore, the position of sheets may be sensed with one or more sensors 210, 212, such as optical sensors, located adjacent the conveyor system 20. In the illustrated embodiment, sensors 210, 212 are located in pathways 34, 36, slightly upstream of decision gates 54, 56, although it is also contemplated that sensors may be located in the media path crossover 30 and/or elsewhere in the conveyor system. The sensors 210, 212 communicate sheet position information to the control system 184.

The control system 184 schedules the entry of the sheets into the crossover junction 70 in such a way as to avoid sheet collisions. For example, in simplex printing, sheets may enter the junction 70 alternately along pathways 50 and 52. If the control system 184 determines that a sheet may collide with a sheet traveling in the other pathway (e.g., based on information from the sensors 210, 212 and/or determined from known parameters), the paper path controller 204 may slow down or accelerate one of the sheets, for example by changing the rotation speed of rollers 110, 112 and/or rollers 114, 116. Other drive systems and print media processing units 12, 14, 16 in the printing system may also be controlled by the paper path controller 204 to change the velocity of the sheets so as to avoid collisions in the junction 70.

The various electronic processing components of the printing system, such as marking engine CPUs 180, 182 and control system 184, may be embodied in any suitable software or hardware. Moreover, the disclosed methods may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like.

U.S. Published Application Nos. 2004/0085561, 2004/0085562, and 2004/0088207 to Fromherz, published May 6, 2004, which are incorporated herein in their entireties by reference, disclose exemplary scheduling systems suited to use with a reconfigurable printing system. Such a scheduling system may be used to schedule the printing of sheets and timing the arrival of sheets at the crossover junction 70 to avoid collisions. The scheduling system and model of the machine may also include features of the scheduler and model of the machine described in U.S. Pat. No. 5,617,214 to Webster, et al., and U.S. application Ser. No. 11/137,251, filed May 25, 2005, entitled "SCHEDULING SYSTEM," by Robert M. Lofthus et al., the disclosures of which are incorporated herein by reference in their entireties.

Optionally, a user input device 206, such as a keyboard or touch screen, may be used by an operator of the printing system to communicate with the control system 184. The operator may input instructions which the control system 184 uses in selecting a printing mode, such as a tandem duplex mode or a simplex mode.

The printing system 10 is an illustrative example. In general, any number of print media sources, media handlers, marking engines, collators, finishers or other processing units can be connected together by a suitable print media conveyor configuration.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A media feeding apparatus comprising:

a media feeding mechanism;

a non-gated media path crossover comprising:

a first crossover pathway comprising of a first input path and a first output path on which sheets of print media are conveyed across a four-way crossover junction without interruption;

a second crossover pathway comprising of a second input path and a second output path on which sheets of print media are conveyed across the four-way crossover junction without interruption, wherein the junction connects the first input path and the first output path and connects the second input path and the second output path, the second crossover pathway intersecting the first crossover pathway at the four-way crossover junction, and wherein the first and second input paths intersect at an angle of greater than 90 degrees, the first and second crossover pathways are defined between baffles, the first input path being defined between a first baffle and a second baffle, the second input path being defined between a third baffle and a fourth baffle, the first output path being defined between a fifth baffle and a sixth baffle, the second output path being defined between a seventh baffle and an eighth baffle, the second and third baffles intersecting, a wall connected with the sixth and seventh baffles, the wall being substantially perpendicular to an imaginary line which intersects the second and third baffles at an opposite side of the junction; and a control system which controls the media feeding mechanism to control the arrival of the sheets of print media at the four-way crossover junction whereby a sheet on the first crossover pathway traverses the junction in an inter-sheet gap between sheets traversing the junction on the second crossover pathway.

2. The media feeding apparatus of claim 1, wherein the second output path has a width which is greater than a width of the second input path.

3. The media feeding apparatus of claim 1, wherein the first pathway extends in a downward direction and the second pathway extends in an upward direction.

4. A printing system comprising the media feeding apparatus of claim 1.

5. The printing system of claim 4, further comprising a first print media processing unit and a second print media processing unit, the media path crossover selectively connecting the first print media processing unit with the second print media processing unit for transferring print media from the first print media processing unit to the second print media processing unit and selectively bypassing at least one of the first and second print media processing units.

6. The printing system of claim 4, wherein the printing system comprises a xerographic printing system.

7. A method of printing, comprising:

providing the media feeding apparatus of claim 1;

conveying sheets of print media from a first marking engine on the first crossover pathway of the print media crossover;

conveying sheets of print media to a second marking engine on the second crossover pathway of the print media crossover; and controlling arrival of the sheets of print media at the four-way junction with the controller such that print media on the second crossover pathway crosses the junction without interruption in inter sheet gaps between sheets crossing the junction on the first crossover pathway.

8. The method of claim 7, wherein the sheets traverse the junction alternately from the first and second crossover pathways.

9. The method of claim 7, further comprising:

in a first mode:

conveying print media between the first marking engine and the second marking engine; and in a second mode:

conveying a first portion of print media from the first marking engine to the first crossover pathway, conveying the first portion of print media from the first crossover pathway to a print media processing unit, the first portion of the print media bypassing the second marking engine;

conveying a second portion of print media which has bypassed the first marking engine to the second crossover pathway, and conveying the second portion of print media between the second crossover pathway and the second marking engine.

* * * * *